US007588136B1

(12) United States Patent
Chang

(10) Patent No.: US 7,588,136 B1
(45) Date of Patent: Sep. 15, 2009

(54) COIN-OPERATED ACTUATION MECHANISM WITH ANTI-VANDALISM DEVICE

(76) Inventor: Kil Jae Chang, T.PiCo, Korea Co., Ltd., 321-37 Suksu, 2 Dong, Anyang City, Kyungkido (KR)

( * ) Notice: Subject to any disclaimer, the term of this patent is extended or adjusted under 35 U.S.C. 154(b) by 103 days.

(21) Appl. No.: 11/982,939

(22) Filed: Nov. 6, 2007

Related U.S. Application Data

(60) Provisional application No. 60/967,629, filed on Sep. 6, 2007.

(51) Int. Cl.
*G07D 7/00* (2006.01)
*G07G 3/00* (2006.01)

(52) U.S. Cl. ..... 194/202; 194/232; 194/235; 194/236; 194/335; 194/338

(58) Field of Classification Search ..... 194/202–204, 194/229, 232–237, 253–255, 292, 334, 335, 194/338
See application file for complete search history.

(56) References Cited

U.S. PATENT DOCUMENTS 3,010,557 A 11/1961 Weitzman
5,657,848 A 8/1997 Schwarzli
6,076,650 A 6/2000 Schwarzli
6,964,328 B2 11/2005 Santilli, Jr. et al.
7,222,711 B2 * 5/2007 Chang ..... 194/254
7,270,225 B1 * 9/2007 Chang ..... 194/254

* cited by examiner

*Primary Examiner*—Jeffrey A Shapiro
(74) *Attorney, Agent, or Firm*—John R. Flanagan

(57) ABSTRACT

An anti-vandalism device in a coin-operated actuation mechanism includes a stop movably extendible and compressible in length and mounted on a coin retainer plate in alignment with a bore therein for moving between a forward blocking position and a rearward unblocking position relative to the bore and to a coin receiving recess in a coin carrier wheel on an opposite side of the retainer plate depending upon whether or not the recess is devoid of a valid coin, and a cam surface actuator defined on a ratchet gear wheel disposed adjacent to the coin retainer plate in a position to engage the stop and cause it to move from its rearward unblocking position to its forward blocking position when the coin receiving recess is devoid of a valid coin and in response to the ratchet gear wheel moving with the coin carrier wheel.

20 Claims, 8 Drawing Sheets

COIN-OPERATED ACTUATION MECHANISM WITH ANTI-VANDALISM DEVICE

This patent application claims benefit of U.S. provisional application No. 60/967,629 filed Sep. 6, 2007.

CROSS-REFERENCE TO RELATED APPLICATION

Cross-reference is hereby made to a copending patent application by the same inventor, entitled "Multi-Coin Operated Actuation Mechanism", assigned Ser. No. 11/982,897 and filed on Nov. 6, 2007, the same date of filing as this patent application, which discloses subject matter in common with this patent application.

BACKGROUND OF THE INVENTION

The present invention generally relates to a coin-operated actuation mechanism for vending machines and, more particularly, is concerned with an anti-vandalism device used in the actuation mechanism.

Products, such as gumballs and plastic capsules or balls containing candy or other novelties inside, are well-known and universally popular with consumers. Typically these products are sold in bulk vendors commonly referred to as vending machines. The vending machine basically includes a product reservoir, a coin-operated actuation mechanism, a dispensing mechanism and a product discharge structure. Historically, these four basic components of a vending machine were designed to cooperate in a single dispensing cycle, in response to insertion of a coin of predetermined denomination into a coin deposit or insertion slot on the actuation mechanism, to serially transfer an item or items of product from the product reservoir down through the dispensing mechanism to an external discharge location via the product discharge structure.

Vending machines of this general type have from time to time been subjected to vandalism and theft. In particular, the efforts of vandals and thieves have been directed toward penetrating the coin insertion slot and bypassing or overriding features in place in the interior of the actuation mechanism, such as pivotal coin diameter sensing dogs, designed to check whether the correct denomination of coin has been inserted through the coin slot and into a coin receiving recess of a rotatable coin carrier wheel of the actuation mechanism located within the vending machine. Typically, plastic straws, paper clips or stiff wires are inserted through the coin insertion slot to defeat the dogs and obtain the merchandise without paying for it, in other words, by theft.

This problem has been recognized for many years. For example, it was discussed in a 1961 patent to Weitzman, U.S. Pat. No. 3,010,557. More recently, it was discussed in a 2000 patent to Schwarzli, U.S. Pat. No. 6,076,650, and in a 2005 patent to Santilli, Jr. et al., U.S. Pat. No. 6,964,328. Different mechanical devices have been proposed at various times in an attempt to block the efforts of vandals and thieves. For example, in the Schwarzli patent a blocking member in the form of a rocker bar is disclosed which is biased to a rest position retracted from a coin insertion slot. The rocker bar is actuated by rotation of a cam disc, mounted on the coin mechanism shaft which is turned by use of an external handle, to pivot from the rest position to a blocking position in which the stem of the rocker bar substantially covers the coin insertion slot and also prevents the cam disc and shaft from continuing and the handle from further turning. While this mechanical device might be effective for a while in blocking access through the coin insertion slot during the most vulnerable part of a single dispensing cycle, the presence of the device would be visible to the vandals and thieves by looking into the coin insertion slot and so attract their attention to the part of the actuation mechanism where they need to concentrate their efforts in attempting to circumvent the normal operation of the device. Furthermore, the adoption of the device would appear to entail changes to the pre-existing structural makeup of the actuation mechanism so significant that such changes might be deemed too expensive and radical to constitute an optimum practical solution to the problem.

It is well known that vandals and thieves are very resourceful types who have always seemed to find new ways to defeat the various devices that have been proposed and even in instances where they may not be successful in stealing items, at a minimum they tend to inflict sufficient damage on vending machines in trying to circumvent the normal operation of such devices that they impose burdensome costs of repair and replacement onto vending machine owners.

Consequently, it would appear that a need still remains for an innovation which will provide a more lasting solution to this problem in the prior art without introducing any new problems in place thereof.

SUMMARY OF THE INVENTION

The present invention provides a coin-operated actuation mechanism having an anti-vandalism device designed to satisfy the aforementioned need. The anti-vandalism device of the present invention allows blocking of rotation of the coin carrier wheel in the absence of receipt of the correct coin or coins or receipt of any coins in the coin receiving recess of the coin carrier wheel. The device and its particular component which achieves the blocking of the coin carrier wheel are not visible to the field of view of vandals and thieves who might look into the actuation mechanism through the coin insertion slot in attempting to discover the source of the blocking action. The anti-vandalism device of the present invention involves the adoption of a minimum of changes in the pre-existing structural makeup of the actuation mechanism. These changes, rather than structural modifications, are mostly the addition of a few new parts to pre-existing components of the actuation mechanism which makes this device a more cost-effective solution. The one change to a pre-existing structure which might be considered a modification is merely making a hole through a pre-existing structure to allow for mounting the device in space already available and through which hole the operative component of the device is projected which enters the unoccupied portion of the coin receiving recess on the coin carrier wheel to block its continued movement. The placement of the device is such that the blocking action is accomplished at a point relatively early point in the rotational path of the dispensing cycle before the coin carrier wheel and a ratchet gear wheel, which both are fixedly mounted to a central shaft of the actuation mechanism, have rotated past the point of no return which is where the one-way ratchet action takes effect and does not allow the rotation to be reversed. This is important since when the blocking action occurs reversal of the turning of the handle is still possible to allow return of the coin carrier wheel and any incorrect coin to the location of the coin insertion slot when the coin can be removed. Thus, the vending machine is not rendered inoperative by the blocking action as would be the case if the rotation of the coin carrier wheel and ratchet gear wheel had progressed beyond the point of no return of the one-way ratchet action.

Accordingly, the present invention is directed to a coin-operated actuation mechanism for a vending machine which includes: (a) a coin carrier wheel mounted to undergo rotation about an axis in a given direction during a dispensing cycle of the vending machine, the coin carrier wheel having a peripheral edge and front and rear sides and at least one coin receiving recess defined in the rear side so as to extend to and open at the peripheral edge thereof and be spaced from the axis such that the coin receiving recess is adapted to receive a coin when the coin carrier wheel is disposed in an initial coin receiving position in the dispensing cycle; (b) a coin retainer plate having front and rear sides and being mounted in a stationary position relative to the coin carrier wheel with the front side of the coin retainer plate disposed adjacent to the rear side of the coin carrier wheel such that the coin retainer plate retains the coin in the coin receiving recess of the coin carrier wheel as the coin carrier wheel is rotated about the axis in the given direction relative to the coin retainer plate from the initial position toward a coin discharging position; (c) a structure mounted to undergo rotation with the coin carrier wheel and having a front surface spaced from and facing toward the rear side of the coin retainer plate as the structure rotates with the coin carrier wheel relative to the coin retainer plate from the initial position toward the coin discharge position, the structure also including means for preventing rotation of the coin carrier wheel and the structure therewith in a direction the reverse of the given direction once the coin carrier wheel has rotated through a predetermined angular displacement in the given direction from the initial position toward the coin discharge position; and (d) an anti-vandalism device including (i) a stop movably extendible and compressible in length and having a front end and a rear end and being mounted on a rear side of the coin retainer plate for undergoing movement between a forward blocking position and a rearward unblocking position, the front end of the stop in the forward blocking position projecting from and beyond a bore in the coin retainer plate and into a portion of the coin receiving recess of the coin carrier wheel when the coin receiving recess devoid of a valid coin is aligned with the bore in the coin retainer plate such that the front end of the stop will engage a segment of the coin carrier wheel at the trailing end of the coin receiving recess and block further rotation of the coin carrier wheel and the structure therewith in the given direction through the predetermined angular displacement from the initial position where halting of both forward and reverse rotation of the coin carrier wheel would occur, the front end of the stop in the rearward unblocking position being retracted into the bore in the coin retainer plate and out of the coin receiving recess of the coin carrier wheel so as not to block further rotation of the coin carrier wheel and the structure therewith in the given direction, and (ii) an actuator in the form of a cam surface defined on the front surface of the structure in a position to engage the rear end of the stop and cause movement of the stop to its forward blocking position when the coin receiving recess is devoid of a valid coin and in response to movement of structure with the coin carrier wheel in the given direction from the initial position, the stop being compressible in length when the coin receiving recess of the coin carrier wheel has a valid coin therein in response to engagement of the front end of the stop with the coin such that due to the compression of the length of the stop the front end thereof does not extend beyond the hole in the coin retainer plate even though the rear end of the stop is engaged by the actuator on the structure.

More particularly, the stop is comprised of a hollow cylinder, a piston cover button, a piston, and first and second coil springs. The hollow cylinder is fixedly mounted at a front end on the rear side of the coin retainer plate so as to surround the bore therein. The piston cover button is movably mounted by a rear end of the cylinder and constitutes the rear end of the stop. The piston includes a head slidably mounted within the cylinder adjacent to the rear end of the cylinder and an elongated stem attached at an inner end to the head and extending to another end disposed within the bore in the coin retainer plate and constituting the front end of the stop. The first coil spring extends between and is disposed at opposite ends in respective depressions in the piston cover button and the head of the piston. The first coil spring in response to engagement of the piston cover button by the cam surface on the rotating structure is sufficiently stiff to transmit to the piston the depressing movement of the piston cover button into the cylinder so as to cause projection of the outer end of the piston stem beyond the bore in the coin retainer plate in absence of a valid coin in the coin receiving recess of the coin carrier wheel. Also, the first coin spring is sufficiently yieldable to absorb such depressing movement of the piston cover button without transmitting the same to the piston in the event of there being a valid coin in the coin receiving recess of the coin carrier wheel blocking the movement of the piston stem beyond the bore. The second coil spring extends about the piston stem between the head of the piston and the rear side of the coin retainer plate and around the bore therein such that the second coil spring will cause retraction of the outer end of the piston stem from beyond the coin retainer plate and into the bore thereof and movement of the piston and the piston cover button away from the coin retainer plate upon disengagement of the piston cover button by the cam surface on the rotating structure.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
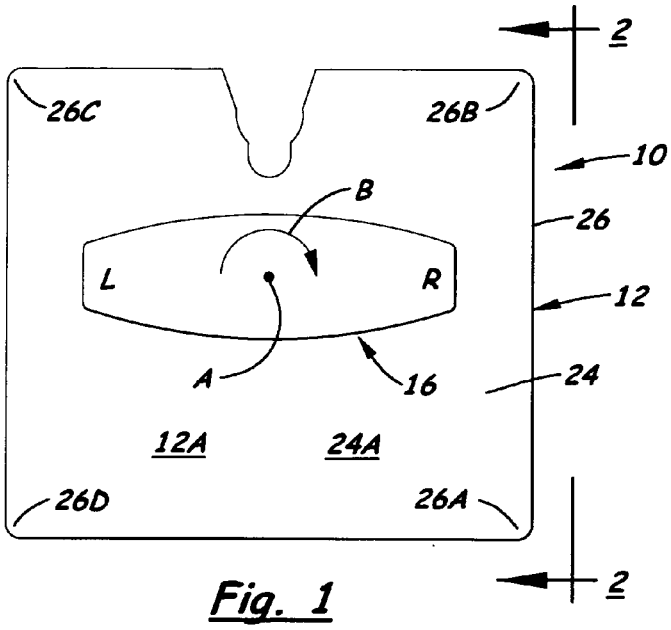
FIG. 1 is a front elevational view of a multi-coin operated actuation mechanism incorporating the anti-vandalism device of the present invention (not shown).

Referring to the drawings and particularly to FIGS. 1 to 9, there is illustrated a multi-coin operated actuation mechanism 10 employing features of the present invention. The actuation mechanism 10 is designed for use in a conventional vending machine (not shown). Basically, the actuation mechanism 10 includes a face or cover plate 12, a central shaft 14, a transverse handle 16, a coin carrier wheel 18, a coin retainer backplate 20, and a ratchet device 22. In a known manner, the actuation mechanism 10 via its cover plate 12 mounts in a slot formed in a front wall of a housing of the vending machine, and the central shaft 14 extends through the cover plate 12 between the exterior and interior of the vending machine housing. In such arrangement, a front side 12A of the cover plate 12 with the transverse handle 16 on the central shaft 14 are disposed at the exterior of the vending machine housing, whereas a rear side 12B of the cover plate 12 with the coin carrier wheel 18 and the ratchet device 22 on the central shaft 14 and the coin retainer backplate 20 on the cover plate 12 are disposed at the interior of the vending machine housing.

Referring now to FIGS. 1 to 4, the cover plate 12 of the actuation mechanism 10 has a central body 24 with front and rear faces 24A, 24B respectively at the front and rear sides 12A, 12B of the cover plate 12 and an outer flange 26 rigidly attached to and extending about a periphery of the central body 24. The outer flange 26 also projects a short distance rearwardly from the rear face 24B of the central body 24 such that the central body 24 and the outer flange 26 together form a rear recessed cavity 28 at the rear side 12B of the cover plate 12. Also, the central body 24 of the cover plate 12 has a central opening 30 defined therein so as to extend between its front and rear faces 24A, 24B and about an axis A of the central body 24. The cover plate 12 further has at least one coin insertion slot 32 defined through an upper portion of the outer flange 26 and partially into the central body 24 and in communication with the cavity 28 such that the slot 32 is disposed in spaced relation to and above the axis A of the cover plate 12. The coin insertion slot 32 is for receiving a set of multiple coins C, such as three US quarters (25-cent pieces) in the illustrated embodiment of the actuation mechanism 10.

The central shaft 14 of the actuation mechanism 10 extends from a front end 14A, disposed outwardly from the front face 24A of its central body 24, through the central opening 30 in the central body 24 and through the rear recessed cavity 28, to a rear end 14B disposed rearwardly of the rear recessed cavity 28 at the rear side 12B of the cover plate 12. The central shaft 14 is rotatably mounted to the central body 24 of the cover plate 12 through the central opening 30 and extends co-axially along the axis A of the cover plate 12. The transverse handle 16 is fixedly attached or fastened to the front end 14A of the central shaft 14, disposed adjacent to the front face 24A of the central body 24 of the cover plate 12, such that the handle 16 may be turned by a user to rotate the central shaft 14 about the axis A in a given direction, such as clockwise, as indicated by an arrow B in FIG. 1.

Figure 9:
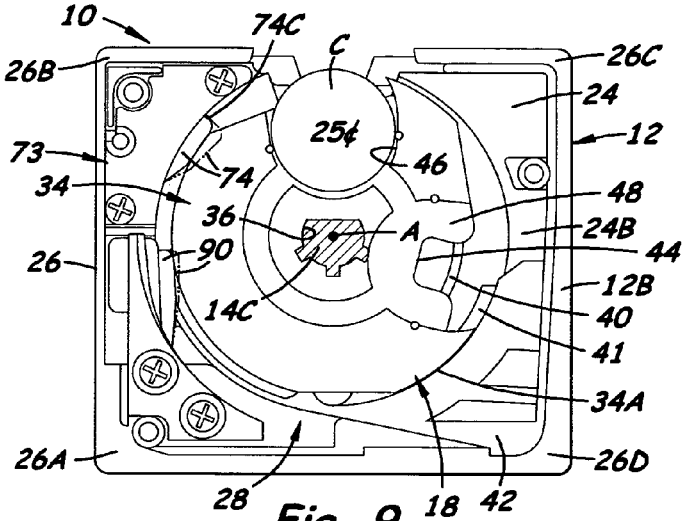
FIG. 9 is a rear elevational view of the actuation mechanism similar to that of FIG. 3 but with a ratchet device and coin retainer backplate of the actuation mechanism removed to show the coin carrier wheel of FIG. 5 disposed at a starting or home position with a first of a pair of coin receiving recesses on the rear side of the coin carrier wheel aligned with a coin slot in the top of the cover plate of the actuation mechanism and a first set of coins inserted through the coin slot and disposed in the first coin receiving recess.
Figure 10:
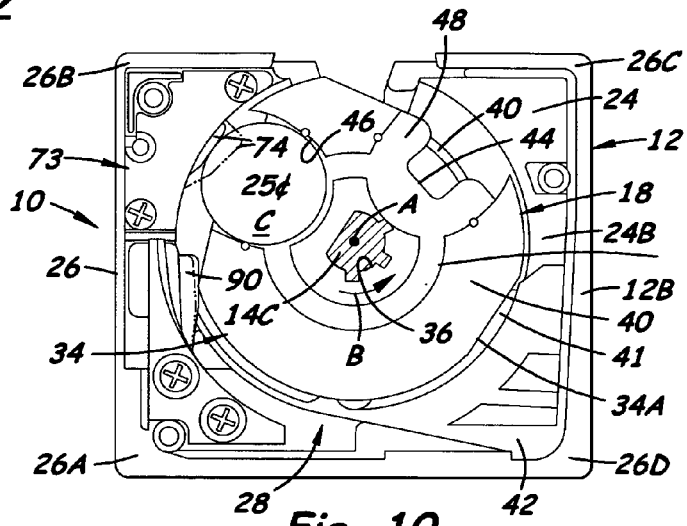
FIG. 10 is a rear elevational view of the actuation mechanism similar to that of FIG. 9, but now showing the coin carrier wheel rotated counterclockwise about forty-five degrees from its home position in FIG. 9 to a first intermediate position such that the first set of coins have engaged and displaced a set of coin sensing dogs which constitute one of the further features of the invention of the patent application cross-referenced above which is incorporated by the actuation mechanism but does not form a part of the present invention.
Figure 11:
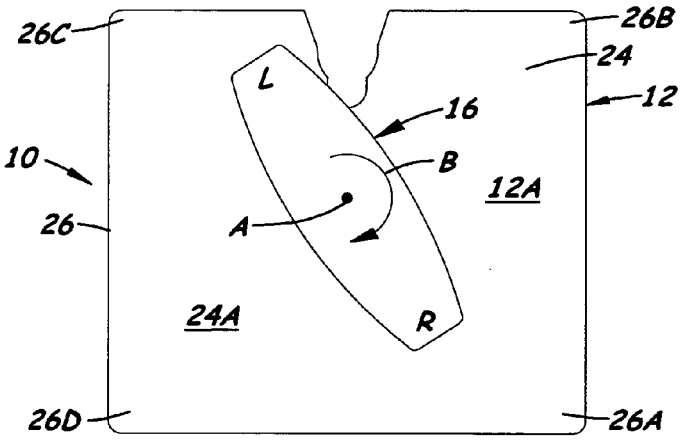
FIG. 11 is a front elevational view of the actuation mechanism similar to that of FIG. 1 but now showing the handle after being turned clockwise about forty-five degrees from its initial position in FIG. 1 which caused the counterclockwise rotation of the coin carrier wheel to the position of FIG. 10.

Referring to FIGS. 5 to 8, there is shown a first of a pair of coin carrier wheels 18 that can be interchangeably employed in the actuation mechanism 10 in accordance with the invention of the patent application cross-referenced above. The coin carrier wheel 18 has a substantially circular body 34 with a central hole 36, a peripheral edge portion 34A, and front and rear sides 34B, 34C. The central hole 36 of the circular body 34 is defined by a flat base 36A and a plurality of grooves 36B spaced apart by a plurality of slightly curved segments 36C which provide a set of features adapting the coin carrier wheel 18 to fit on and mount over an axial segment 14C of the central shaft 14 having a set of features complementary thereto as seen in FIG. 9, namely a flat surface 14D and a plurality of splines 14E spaced apart by a plurality of slightly curved surfaces 14F. In such manner, the coin carrier wheel 18 is disposed in the rear recessed cavity 30 of the cover plate 12 to undergo rotation with the central shaft 14, which is counter-clockwise as viewed in FIG. 9, upon turning of the handle 16 relative to the cover plate 12 and about the axis A in the given direction B, which is clockwise as viewed in FIG. 1. When the coin carrier wheel 18 is so mounted over the axial segment 14C of the central shaft 14, a front portion 34D at the front side 34B of the circular body 34 is defined and surrounded by a middle portion 34E of the circular body 34 so as to define a recess 37 about the periphery of the front portion 34D at the front side 34B of the circular body 34 such that the front portion 34D will seat within a central space 38 bounded by a circular guide rail 40 formed on the rear face 24B of the central body 24 of the cover plate 12. Thus, the coin carrier wheel 18 only at its middle portion 34E, adjacent to the periphery of its front portion 34D, will overlap and make frictional contact with the cover plate 12 at the circular guide rail 40 during rotation of the coin carrier wheel 18 relative to the cover plate 12 in the rear recessed cavity 28 at the rear side 12B of the cover plate 12. The middle portion 34E of the circular body 34 is defined and surrounded by a rear portion 34F at the rear side 34C of the circular body 34 so as to form a recess 39 about the periphery of the middle portion 34E at the front side 34B of the central body 34 such that only the rear portion 34F will overlap a curved guide rail 41 on the cover plate 12 adjacent to a coin discharge location 42 defined on the cover plate 12.

Figure 13:
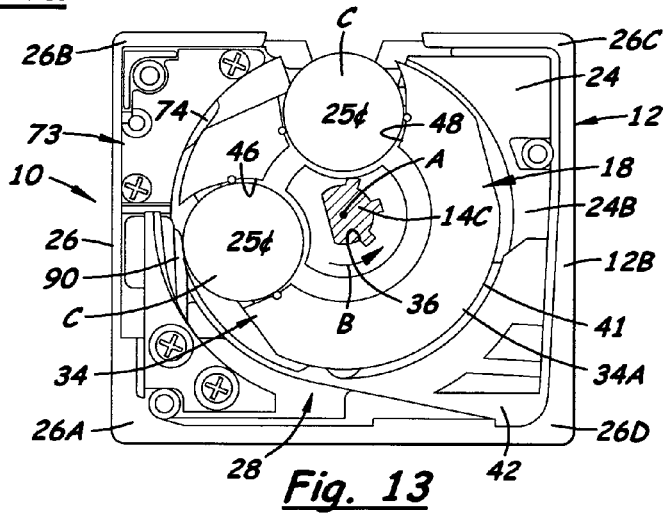
FIG. 13 is a rear elevational view of the actuation mechanism similar to that of FIG. 10 but now showing the coin carrier wheel rotated counterclockwise about ninety degrees from the initial position of FIG. 9 to a second intermediate position such that the first set of coins now engage and displace a backup dog and a second of the pair of coin receiving recesses on the coin carrier wheel is aligned with the coin slot and a second set of coins have been inserted through the coin slot and disposed in the second coin receiving recess.
Figure 14:
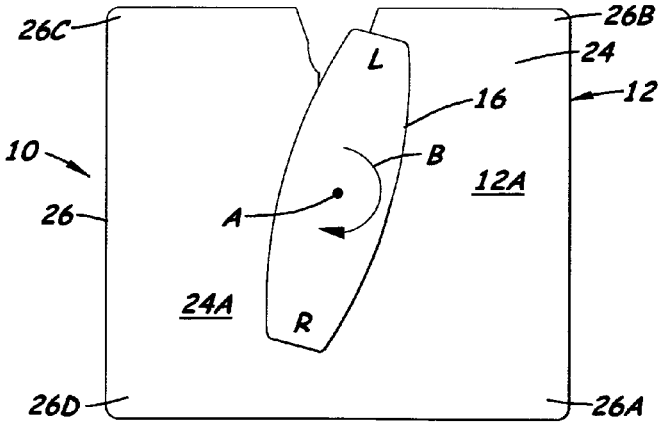
FIG. 14 is a front elevational view of the actuation mechanism similar to that of FIG. 11 but now showing the handle after being turned clockwise about ninety degrees from its initial position in FIG. 1 and forty-five degrees from its position shown in FIG. 11 which caused the counterclockwise rotation of the coin carrier wheel to the position of FIG. 13.
Figure 15:
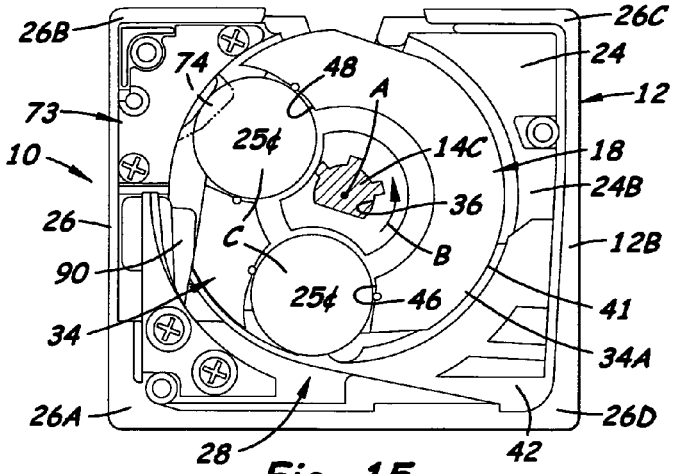
FIGS. 15 to 18 are alternately rear and front elevational view of the actuation mechanism correspondingly similar to those of FIGS. 13 and 14 but now showing the coin carrier wheel and handle at successive intermediate positions so as to deliver the coins to a discharge location.
Figure 16:
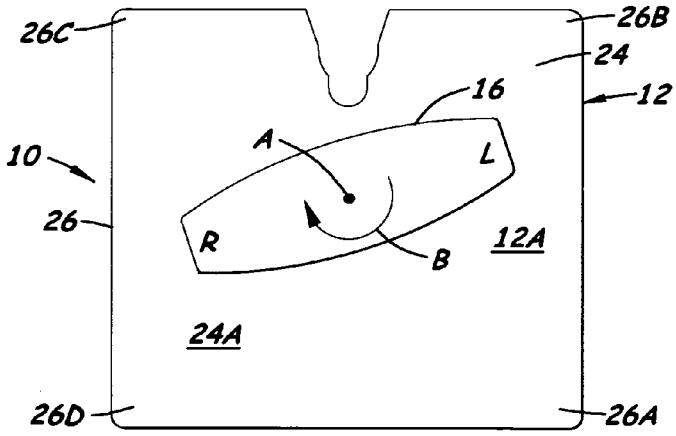
Figure 22:
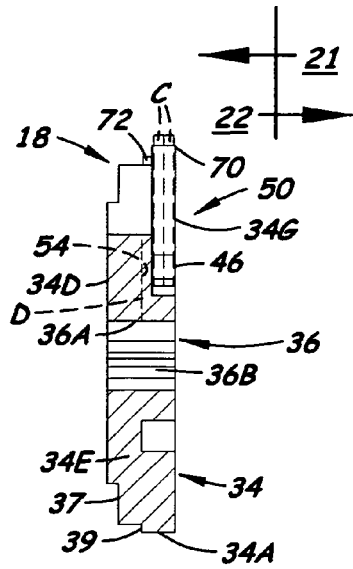
FIG. 22 is another vertical cross-sectional view of the second coin carrier wheel taken along line 22-22 of FIGS. 19 and 20.
Figure 23:
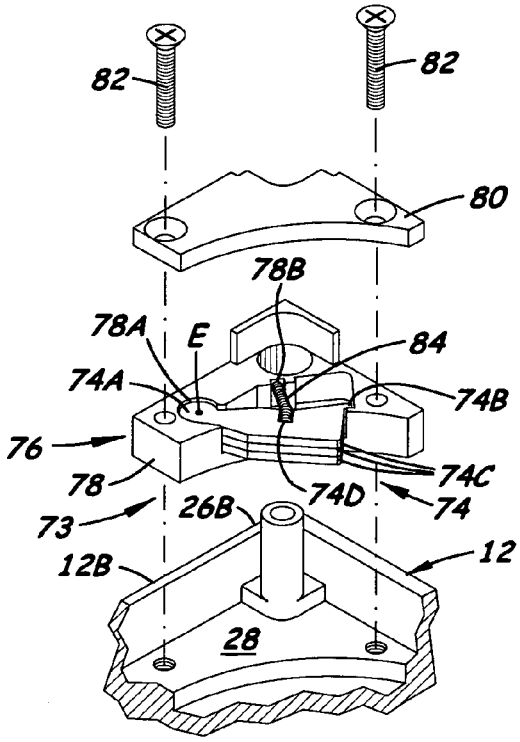
FIG. 23 is an enlarged exploded view of a coin diameter checking device constituting still another of the features of the invention of the patent application cross-referenced above but does not form a part of the present invention, the checking device being shown together with a fragmentary portion of the cover plate on which the device will be mounted.
Figure 24:
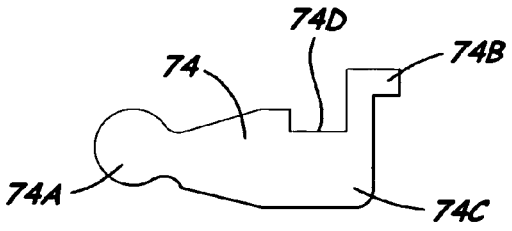
FIG. 24 is an enlarged side elevational view of one of the coin periphery sensing dogs of the checking device.
Figure 25:
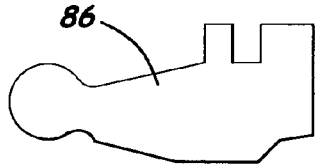
FIG. 25 is an enlarged side elevational view of one of the spacers of the checking device.
Figure 26:
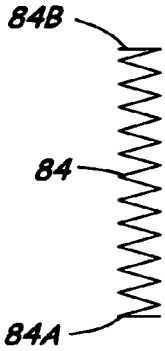
FIG. 26 is an enlarged side elevational view of one of the coin springs of the checking device.

The coin carrier wheel 18 also has first and second notches 43, 44 defined into the front and middle portions 34D, 34E of the circular body 34 so as to extend to and open at the peripheral edge portion 34A thereof and match the profile of the slot 32 in the cover plate 12, and further has first and second coin receiving recesses 46, 48 defined into the rear portion 34F of the circular body 34 so as to extend to and open at the peripheral edge portion 34A thereof. The notches 43, 44 are aligned with the recesses 46, 48 and facilitate the depositing of coins C into the recesses 46, 48. Also, the segments of the middle portion 34E forming the first and second notches 43, 44 define front walls for the first and second coin receiving recesses 46, 48 for holding the coins C therein. The first notch 43 and first recess 46 are located side-by-side and angularly spaced about ninety degrees from the second notch 44 and second recess 48 about the axis A of the central body 24 of the cover plate 12. At a leading home position of the coin carrier wheel 18 as seen in FIG. 9, the first notch 43 and first recess 46 are aligned with the coin insertion slot 32 in the cover plate 12. After rotation of the coin carrier wheel 28 and the central shaft 14 by turning the handle 16 in the given direction B to a trailing position as seen in FIG. 13, the second notch 44 and second recess 48 become aligned with the coin insertion slot 32 in the cover plate 12. The first and second coin receiving recesses 46, 48 have predetermined widths such that a first set of a preselected number of multiple coins C, such as three in number, can be deposited through the coin insertion slot 32 into the multiple coin accepting regions 50 of the first coin receiving recess 44 when the coin carrier wheel 18 is at the leading first position and a second set of preselected number of multiple coins C can be deposited through the coin insertion slot 32 into multiple coin accepting regions 52 of the second coin receiving recess 48 when the coin carrier wheel 18 is at the trailing position. In the case of the use of another combination of multiple coins C, a second of the pair of coin carrier wheels 18, such as seen in FIGS. 19 to 22, can be interchanged for the first coin carrier wheel seen in FIGS. 5 to 8. As seen in FIG. 22, the second coin carrier wheel 18 has a coin non-accepting region 54 being separated by dashed line D from the middle portion 34E of the central body 34, adjacent to one or the other or both of the first and second multiple coin accepting regions 50, 52. As an alternative to the one coin insertion slot 32, the cover plate 12 could have two such slots angularly displaced from one another, for example, by the same distance as the first and second coin receiving recesses 46, 48, although the use of one coin insertion slot 32 is preferred.

Figure 2:
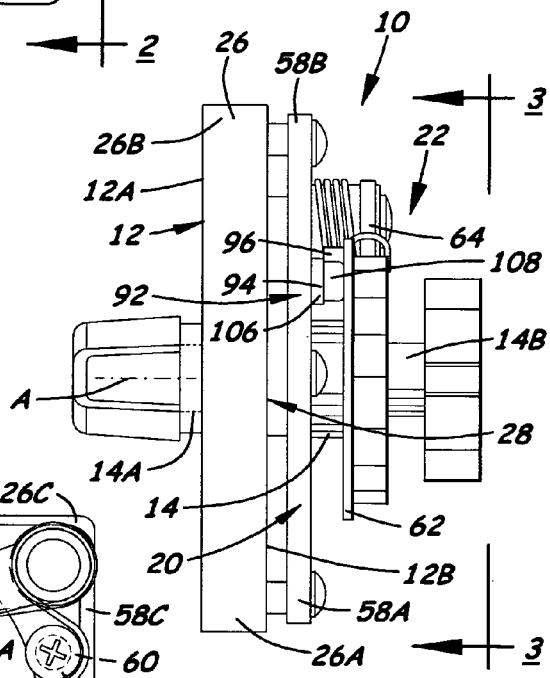
FIG. 2 is a side elevational view of the actuation mechanism as seen along line 2-2 of FIG. 1, showing portions of the anti-vandalism device.
Figure 3:
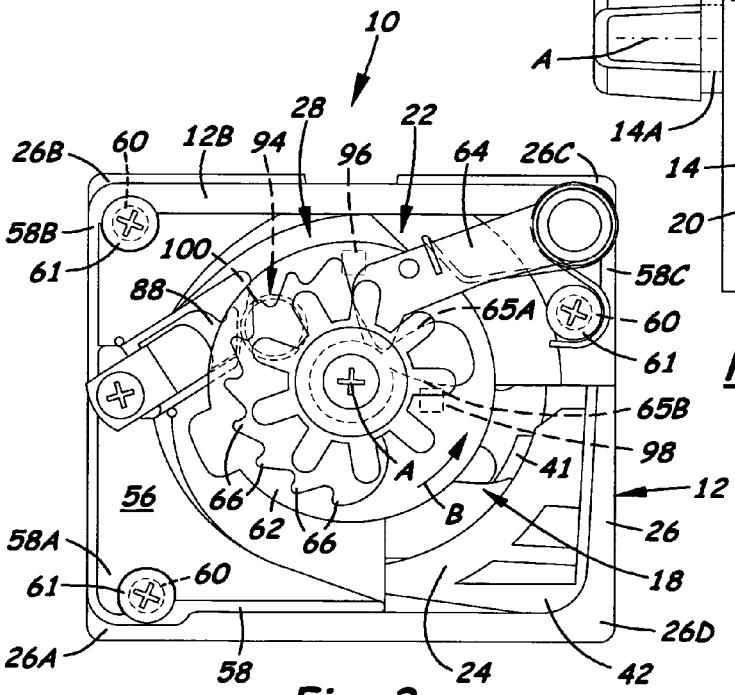
FIG. 3 is a rear elevational view of the actuation mechanism as seen along line 3-3 of FIG. 2 also showing in dashed outline form portions of the anti-vandalism device.
Figure 4:
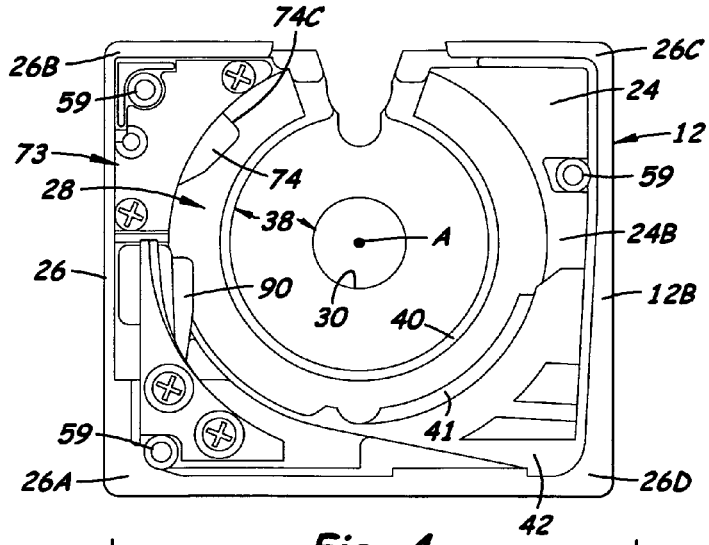
FIG. 4 is a rear elevational view of a face or cover plate of the actuation mechanism of FIG. 3.
Figure 5:
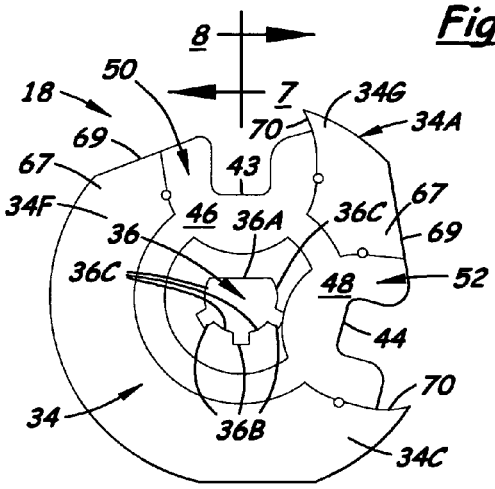
FIG. 5 is a rear elevational view of a first of a pair of interchangeable coin carrier wheels constituting one of the features of the invention of the patent application cross-reference above which is used in the actuation mechanism of FIG. 3.
Figure 6:
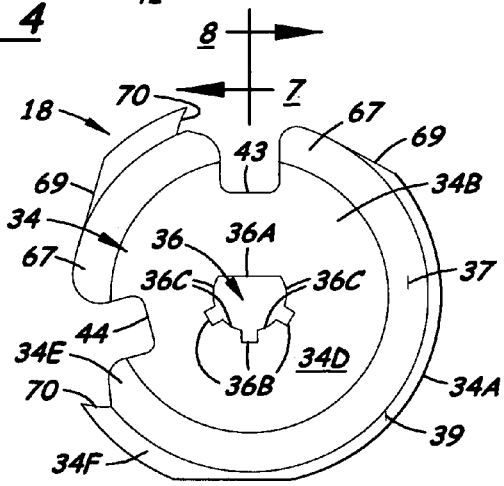
FIG. 6 is a front elevational view of the first coin carrier wheel of FIG. 5.
Figure 7:
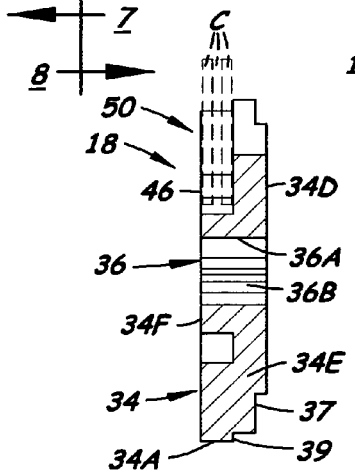
FIG. 7 is a vertical cross-sectional view of the first coin carrier wheel taken along line 7-7 of FIGS. 5 and 6.
Figure 8:
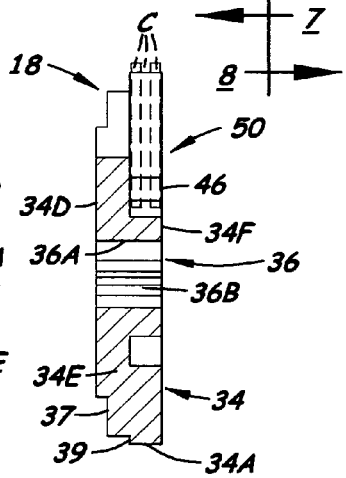
FIG. 8 is another vertical cross-sectional view of the first coin carrier wheel taken along line 8-8 of FIGS. 5 and 6.
Figure 17:
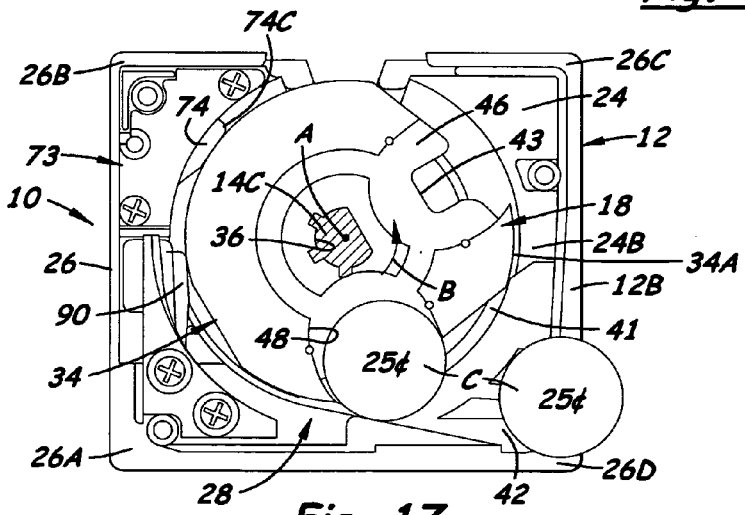
Figure 18:
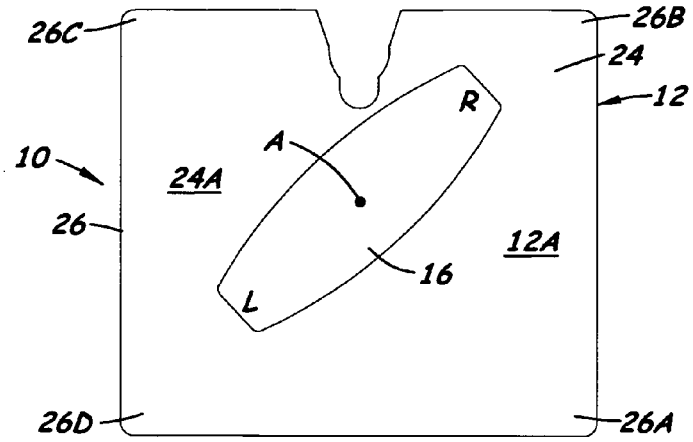
Figure 19:
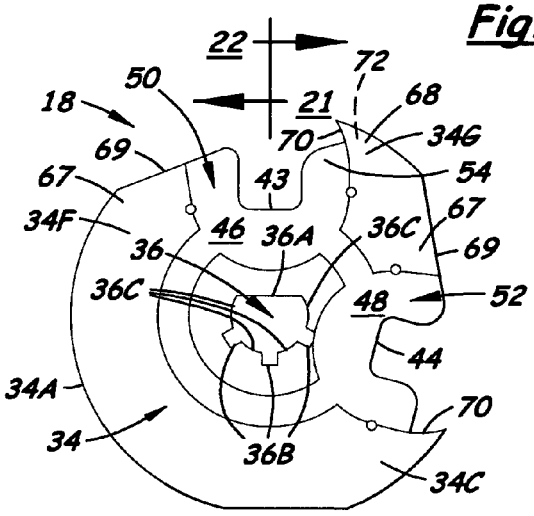
FIG. 19 is a rear elevational view of a second of a pair of interchangeable coin carrier wheels used in the actuation mechanism of FIG. 3 which constitute another of the features of the invention of the patent application cross-reference above and not part of the present invention.
Figure 20:
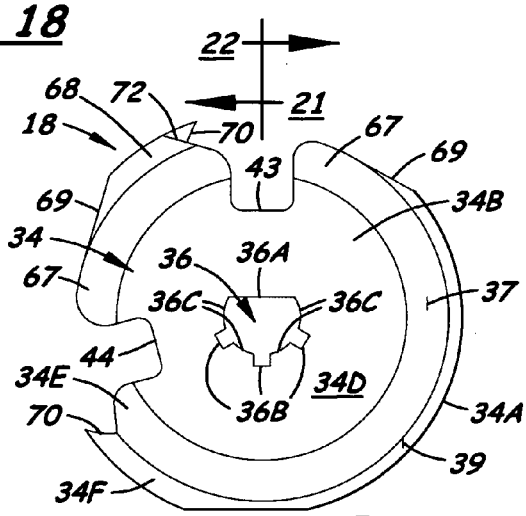
FIG. 20 is a front elevational view of the second coin carrier wheel of FIG. 19.
Figure 21:
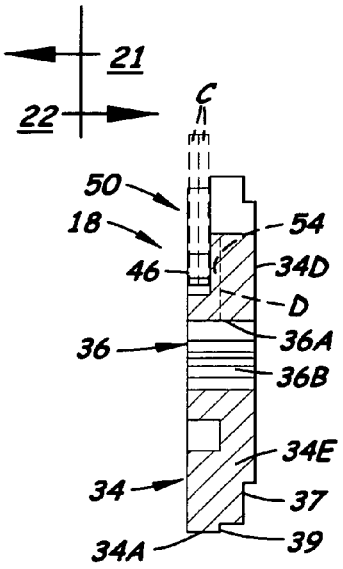
FIG. 21 is a vertical cross-sectional view of the second coin carrier wheel taken along line 21-21 of FIGS. 19 and 20.

As seen in FIGS. 2 and 3, the coin retainer backplate 20 of the actuation mechanism 10 has a central portion 56 connected to and partially surrounded by a peripheral portion 58 by which the coin retainer backplate 20 is attached to the cover plate 12 at its rear side 12B. A plurality of threaded holes 59 are defined in three of the corner locations 26A, 26B, 26C of the outer flange 26 of the cover plate 12 which are alignable with a plurality of holes 60 defined in three of the corners 58A, 58B, 58C of peripheral portion 58 of the backplate 20 for attaching the backplate 20 to the cover plate 12 by a plurality of screws 61. The central portion 56 of the backplate 20 extends across the rear recessed cavity 28 of the cover plate 12 so as to be stationarily disposed closely adjacent to the rear side 34C of the circular body 34 of the coin carrier wheel 18 such that the central portion 56 of the backplate 20 defines a rear wall to the first and second coin receiving recesses 46, 48 of the coin carrier wheel 18 which retains the first and second sets of multiple coins C in the first and second coin receiving recesses 46, 48 as the coin carrier wheel 18 is rotated with the central shaft 14, by turning the handle 16, from its initial position through several intermediate positions to the discharge location 42, as shown in FIGS. 9 to 18. Specifically, in FIGS. 13 to 18 there is shown examples of successive intermediate positions through which the coin carrier wheel 18 is rotated and also positions through which the handle 16 is turned to rotate the central shaft 14 upon which both the handle 16 and the coin carrier wheel 18 are mounted for rotation therewith. These positions are felt to be self-explanatory and thus need not be described further. The ultimate objective, by the turning of the handle 16 and the rotation of the coin carrier wheel 18, is the delivery of both sets of coins to the coin discharge location 42 on the cover plate 12 of the actuation mechanism 10 at the corner location 26D, as shown in FIG. 17.

Referring again to FIGS. 2 and 3, the ratchet device 22 of the actuation mechanism 10 includes a ratchet gear wheel 62 fixedly mounted to the rear end 14B of the central shaft 14 for undergoing rotation therewith. The ratchet device 22 also includes a spring-loaded pawl 64 pivotally mounted to the backplate 20 adjacent to the ratchet gear wheel 62. The pawl 64 is positioned to engage in a pair of successive notches 65A, 65B and a series of successive teeth 66 defined about the ratchet gear wheel 62 such that the central shaft 14, ratchet gear wheel 62 and coin carrier wheel 18 can only be rotated in the given direction B once that the central shaft 14 has rotated sufficiently to bring the pawl 64 into engagement with the second notch 65B on the ratchet gear wheel 62. Once the pawl 64 is at the position of notch 65B, and the coin carrier wheel 18 and handle 16 are thus at the respective positions seen in FIGS. 13 and 14, then the spring-loaded pawl 64 of the ratchet device 22 prevents reverse rotation of the central shaft 14, ratchet gear wheel 62 and coin carrier wheel 18.

In accordance with the features of the invention of the patent application cross-referenced above and not forming part of the present invention, the coin carrier wheel 18 further includes a plurality of side-by-side outer segments 67, 68 provided at the peripheral edge portion 34A of the circular body 34 adjacent to an outer leading and trailing ends of the first and second coin receiving recesses 46, 48 thereon. Each outer segment 67 defines a cutaway or relief surface 69 at the outer leading end of each of the first and second coin receiving recesses 46, 48 and either an abutment surface 70 at the outer trailing end of each of the first and second coin accepting regions 50, 52 of the first and second coin receiving recesses 46, 48 or an inclined camming surface 72 at the outer trailing end of each coin non-accepting region 54 adjacent to a corresponding one of the coin accepting regions 50, 52 of a given one of the first or second coin receiving recesses 46, 48.

In accordance with the further features of the invention of the patent application cross-referenced above and not forming part of the present invention, first and second coin carrier wheels 18 of an interchangeable pair thereof are shown respectively in FIGS. 5 to 8 and 19 to 22. The first coin carrier wheels 18 shown in FIGS. 5-8 has first and second coin accepting recesses 46, 48 designed to hold 3 coins C each, namely US quarters or 25-cent pieces, as shown in dashed outline form in FIGS. 7 and 8. The second coin carrier wheel 18 shown in FIGS. 19 to 22 has first and second coin accepting recesses 46, 48 designed to hold two coins and three coins, respectively, which again are US quarters or 25-cent pieces. With respect to the second coin carrier wheel 18, in accordance with the features of the invention of the cross-referenced patent application, a coin non-accepting region 54 is present in conjunction with the coin accepting recess 48 and has a camming surface 72 thereon at its outer segment 68. It can be readily observed that, of the relief, abutment and camming surface 69, 70, 72, the abutment surface 70 is displaced the greatest distance from the central axis A, the relief surface 69 is displaced the smallest distance from the central axis A, and points along the inclined camming surface 72 are displaced an intermediate distance from the central axis A between the greatest and smallest distances.

Referring now to FIGS. 3, 4 and 23 to 26, also in accordance with the additional features of the invention of the patent application cross-referenced above and not forming part of the present invention, the actuation mechanism 10 further includes a coin diameter checking device 73 which includes a set of multiple side-by-side coin periphery sensing dogs 74 which, matching in number the maximum number of coins of the first and second sets of multiple coins, such being three coins in the example of FIGS. 5 to 8, are for checking whether or not the coins C are of the correct diameter. These dogs 74 are mounted as a unit in a housing 76 comprised of a base 78 and a cover 80 which are fastened by screws 82 to the cover plate 12 adjacent to the outer flange 26, proximate the one corner location 20B, and within the rear recessed cavity 28 and adjacent to the coin carrier wheel 18. More particularly, at their first ends 74A the coin periphery sensing dogs 74 are circular shaped and fitted into a cylindrical cavity 78A defined in the housing base 78 for undergoing pivotal movement toward and away from the peripheral edge portion 34A of the circular body 34 of the coin carrier wheel 18 and about an axis E spaced from and extending parallel to the axis A. The coin periphery sensing dogs 74 also have respective opposite second ends 74B with outer tip surfaces 74C which are substantially identical in configuration with one another and correspondingly are aligned with and adapted to respectively engage the side-by-side outer segments 68 on the peripheral edge 34A of the circular body 34 of the coin carrier wheel 18 defining either the abutment surface 70 or the camming surface 72 at the outer trailing end of each of the first and second coin receiving recesses 46, 48 in the respective coin carrier wheels 18. Between their opposite first and second ends 74A, 74B, the coin periphery sensing dogs 74 have notches 74D which each respectfully receives a coil spring 84 at one end 84A thereof which is seated at its opposite end 84B in a recess 78D in the housing base 78. Also between each of the adjacent pairs of coin dogs 74 is disposed a thin spacer 86 being mounted at one end to the cavity 78A of the housing base 78 in a manner similar to the mounting of the coin periphery sensing dogs 74. The spacers 86 function to confine the coin springs 84 in place and prevent interference with movement of neighboring coin periphery sensing dogs 74. Thus, the coin periphery sensing dogs 74 are individually and separately pivotally movable toward and away from the coin carrier wheel 18 and are biased by the coil springs 84 to pivot toward the coin carrier wheel 18 and into contact therewith at the outer tip surfaces 74C of the second ends 74B of the coin periphery sensing dogs 74. The outer tip surfaces 74C have like shapes functioning as cam followers adapting each of the coin periphery sensing dogs 74 to ride over one of the multiple coins C when deposited in one of the first and second coin receiving recesses 46, 48 and thus not engage with the corresponding abutment surface 70 at the trailing end of a coin accepting region 50, 52 of one of the first and second coin receiving recesses 46, 48 of the coin carrier wheel 18 when the latter moves from an initial position as seen in FIG. 9 to a first intermediate position seen in FIG. 10 upon turning of the handle 16 in the given direction B from the initial position seen in FIG. 1 to the angularly displaced clockwise position seen in FIG. 11. Also, the shape of the outer tip surfaces 74C of the second ends 74B of the coin periphery sensing dogs 74 still functioning as cam followers would adapt each of the coin periphery sensing dogs 74 to make contact with and ride over the corresponding camming surface 72 at the trailing end of the coin non-accepting region 54 adjacent the first coin accepting region 50 as seen in FIGS. 19 to 22.

Figure 12:
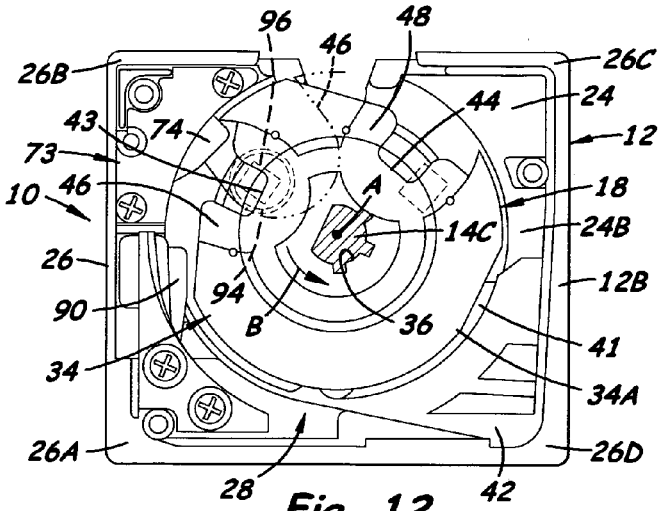
FIG. 12 is a rear elevational view of the actuation mechanism similar to that of FIG. 10 but now showing the coin carrier wheel, without coins inserted into the first coin receiving recess, rotated counterclockwise about fifteen degrees farther from its position in FIG. 10 such that now the set of coin sensing dogs have sensed the absence of the coins and engaged an edge of the coin carrier wheel defining a trailing portion of the first coin receiving recess and blocked further rotation of the coin carrier wheel.

However, as shown in FIG. 12, the coin periphery sensing dogs 74 will prevent movement of the coin carrier wheel 18 and the coin receiving recesses 46, 48 thereon past the coin periphery sensing dogs 74 through contact with the corresponding abutment surfaces 70 on the outer segments 68 in response to any of first and second sets of multiple coins not being deposited into the coin accepting regions 50, 52 of the first and second coin receiving recesses 46, 48. In accordance with the additional features of the invention of the patent application cross-referenced above and not forming part of the present invention, the relief surfaces 69 being at a lesser distance from the central axis A reduce the magnitude of the force that needs to be applied against the dogs 74 by the coin carrier wheel 18, by allowing the dogs 74 to extend further toward the coin carrier wheel 18, during the rotation of the wheel 18 about the portion of each dispensing cycle leading up to when the coin receiving recesses 46, 48 are aligned with the dogs 74 and the coins therein engage the dogs 74 and force them to ride over the coins. Thus, the relief surfaces 69 allow smoother or easier exertion, and one requiring less strength, for turning the handle 16 and rotating the coin carrier wheel 18.

In according to conventional practice, the actuation mechanism 10 also includes a coin thickness sensing dog 88 mounted to the coin retainer backplate 20 and extending to contact with the front portion 34D of the circular body 34 of the coin carrier wheel 18 downstream from the first coin receiving recess 46. The coin thickness sensing dog 88 is adapted to contact the face of a coin to check the thickness of the coins C deposited in the recesses 46, 48 and will engage the trailing edge of the recesses 46, 48 if the coins are below the required thickness.

Further, in accordance with further features of the invention of the patent application cross-referenced above and not forming a part of the present invention, the actuation mechanism 10 includes a backup detent such as in the form of another coin periphery sensing dog 90, pivotally mounted to the cover plate 12 adjacent to the outer flange 26 thereof and within the rear recessed cavity 28 and angularly displaced downstream from the set of multiple coin periphery sensing dogs 74 and one coin thickness sensing dog 88. The backup dog 90 functions to engage the coin carrier wheel 18 at the abutment surface 70 of the coin accepting regions 50, 52 of the first and second coin-receiving recesses 46, 48 and halt further movement of the coin carrier wheel 18 should the operation of the coin dogs 74, 88 be circumvented by an unauthorized act such as insertion of a stiff drinking straw between the periphery of the coin carrier wheel 18 and the coin dogs 74, 88. Although the use of the backup dog 90 will generally serve to prevent such acts of vandalism as just described, unfortunately when the coin carrier wheel 18 has rotated sufficiently to bring either one of its coin receiving recesses 46, 48 into proximity of the backup dog 90, the ratchet wheel 62 also has rotated sufficiently to cause the pawl 64 to pass the first notch 65A and at least enter the second notch 65B such that is impossible to reverse rotate the coin carrier wheel 18 to return either of its coin receiving recesses 46, 48 to the positions of FIG. 9 or 13 in which either of them are aligned with the coin insertion slot 32. Although the coin carrier wheel 18 is prevented from being rotated through a full dispensing cycle such that an item will be dispensed without the collection of coins in payment therefor, the vending machine is rendered inoperative until the operator can service the machine so as to return it to working condition. During the interim, unfortunately the vending machine cannot dispense any items nor earn any revenue for its owner.

Turning now to FIGS. 2, 3, 12 and 27-29, there is illustrated an anti-vandalism device (AVD), generally designated 92, with features constituting the present invention. The AVD 92 will overcome the problem just described by obviating the need, or making it unnecessary, to rely on the backup dog 90 to prevent such vandalism of the actuation mechanism 10 of the vending machine and the resulting theft of items from the vending machine by shutting down the vending machine from further normal working operation. As will become clear hereinafter, the AVD 92 stops rotation of the coin carrier wheel 18 prior to it reaching the point where reversal of its rotation back to the initial position is not possible by merely reversal of the direction in which the handle 16 is turned. While the AVD 92 is illustrated as applied to the actuation mechanism 10 described above which has either of the coin carrier wheels 18 with first and second coin receiving recesses 46, 48 being each designed for receiving multiple coins C, it should be understood that the AVD 92 is equally applicable to an actuation mechanism, not incorporating the above-described configuration and features of the actuation mechanism 10 of the invention of the patent application cross-referenced above, which has a more basic or simple receiving recess for receiving a single coin and with a single coin periphery sensing dog and a single coin thickness sensing dog for ensuring the deposit of the correct coin into the recess. This basic actuation mechanism construction is well-known in the prior art. Thus, hereinafter for the purpose of simplifying the description without sacrificing any understanding of the scope and breadth of the advantages of the AVD 92 as a comprehensive solution to the type of vandalism mentioned above, the operation of the AVD 92 will be described in relation to just the first coin receiving recess 46 of the coin carrier wheel 18 in view that such operation would merely be repeated with respect to the second coin receiving recess 48 of the coin carrier wheel 18.

Figure 27:
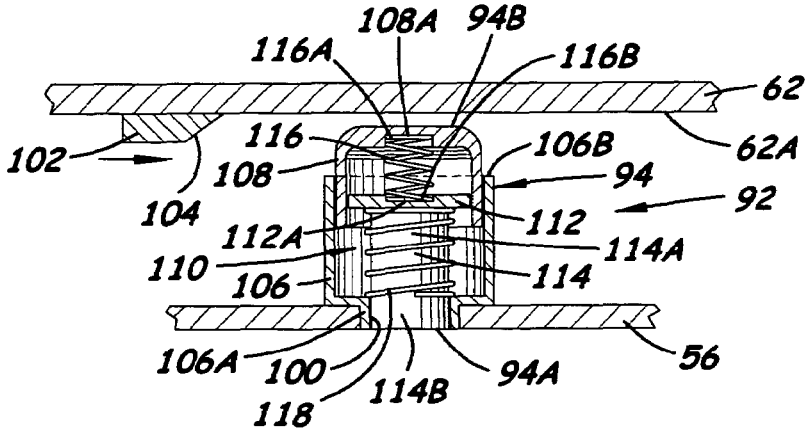
FIG. 27 is an enlarged cross-sectional view of an anti-vandalism device incorporated by the actuation mechanism and constituting the present invention, showing the anti-vandalism device in an initial or starting position.
Figure 28:
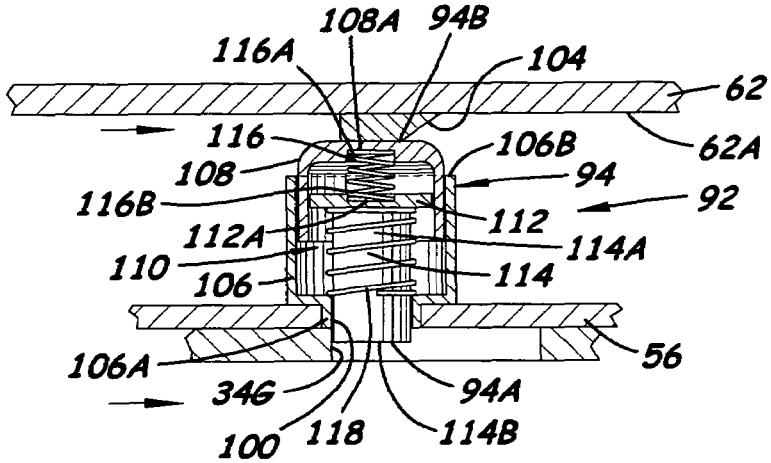
FIG. 28 is another enlarged cross-sectional view of the anti-vandalism device now showing it blocking movement of the coin carrier wheel when less than the required number of coins are present in the coin receiving recess of the coin carrier wheel.

Basically, the AVD 92 includes a stop 94 and an actuator 96. A second actuator 98 is shown in FIGS. 3 and 12 which is involved in a repeat of the blocking operation performed by the AVD 92 in conjunction with the second coin receiving recess 48 and so it will not be discussed further hereinafter. The stop 94 has a front end 94A and a rear end 94B and a construction which, as will be explained in detail later, permits it to be movably extendible and compressible in length. The stop 94 is mounted on the rear side 56A of the central portion 56 of the coin retainer backplate 20 so as to allow it to transition between a non-blocking state or condition, as seen in FIG. 27, and a blocking state or condition, as seen in FIG. 28. In the non-blocking condition of FIG. 27, which is the normal "at rest" state or condition of the AVD 92, the stop 94 is at its extended length with its front end 94A in a retracted position "at rest" in a bore 100 defined in the coin retainer backplate 20. As seen in FIG. 3, the bore 100 and thus the stop 94 are located only a very short distance upstream from the leading end of the coin thickness sensing dog 88 and inwardly from and adjacent to the coin periphery sensing dogs 74. In such retracted position, the front end 94A of the stop 94 is located out of the path of the coin carrier wheel 18 so as not to block its rotation in the given direction B. In FIG. 12, when the first coin receiving recess 46 is at the dashed line position the stop 94 of the AVD 92 is in its normal "at rest" condition with its front end 94A in the retracted position. In such retracted position, the front end 94A of the stop 94 is not within the span of vision of a person attempting to look through any narrow gap 95 remaining at the left end of the coin insertion slot 32. Thus, the AVD 92 is effectively invisible to anyone attempting to figure out why the insertion of a straw between the periphery of the coin carrier wheel 18 and the coin periphery dog 74 (instead of a coin or coins in the slot 32) will no longer allow turning of the handle 16 and rotation of the coin carrier wheel 18 perhaps more than an initial forty degrees through one complete cycle of operation. In the blocking condition of FIG. 28, the front end 94A of the stop 94 projects from and beyond the bore 100 in the coin retainer backplate 20 into the coin receiving recess 46 of the coin carrier wheel 18 when the coin receiving recess 46 is devoid of a valid coin C and contiguous with the bore 100. As the coin carrier wheel 18 moves in the given direction B, the front end 94A of the stop 94 will ultimately engage an edge segment 34G of the circular body 34 of the coin carrier wheel 18 at the trailing edge of the coin receiving recess 46 and block further rotation of the coin carrier wheel 18 in the given direction B to the location of the backup dog 90 where halting of the coin carrier wheel 18 results in prevention of both forward and reverse rotation of the coin carrier wheel 18 from occurring in either direction from that location (or, for that matter, prevents rotation of the coin carrier wheel 18 even to the location of the coin thickness sensing dog 88 at which location reverse rotation of the coin carrier wheel 18 is still possible). Thus, it can be readily understood that the need for the backup dog 90 is obviated by the AVD 92 of the present invention.

Figure 29:
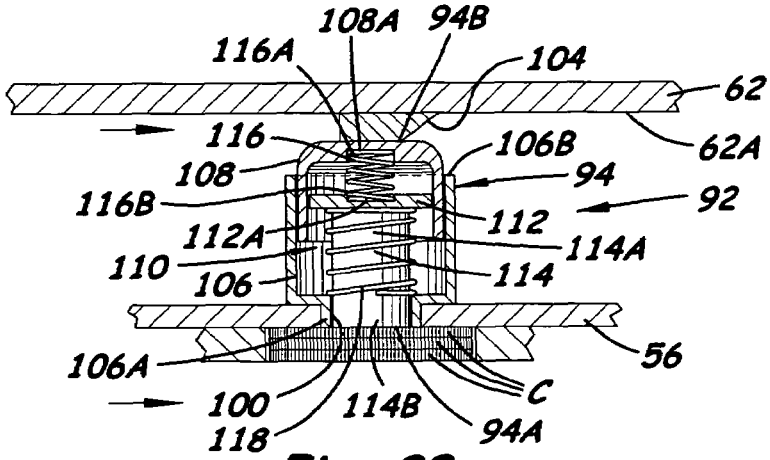
FIG. 29 is still another enlarged cross-sectional view of the anti-vandalism device now showing it not blocking movement of the coin carrier wheel when the required number of coins are present in the coin receiving recess of the coin carrier wheel.

As seen in FIGS. 2, 3, 28 and 29, the actuator 96 of the AVD 92 preferably takes the form of wedge-shaped protuberance 102 attached on the front surface 62A of the ratchet gear wheel 62 which defines an inclined cam surface 104 in a position calculated to engage the rear end 94B of the stop 94 and cause movement, such as depressing, of the stop 94 from its non-blocking position to its blocking position when the coin receiving recess 46 is devoid of a coin and in response to movement of the ratchet gear wheel 62 with the coin carrier wheel 18 from the initial position in the given direction B past the coin periphery sensing dog 74. The stop 94 by being compressible in length allows the actuator 96 to engage the stop 94 and depress it independent of whether a valid coin is absent from (as seen in FIG. 28) or occupies (as seen in FIG. 29) the coin receiving recess 46. Thus, when the coin receiving recess 46 of the coin carrier wheel 18 has a valid coin or coins C therein, as seen in FIG. 29) the front end 94A of the stop 94 will engage with the coin C and not protrude from the bore 100. Instead, the length of the stop 94 will compress so as to accommodate its front end 94A not extending beyond the bore 100 in the coin retainer backplate 20 even though the rear end 94B of the stop 94 is engaged and depressed by the actuator 96 (or cam surface 104) on the ratchet gear wheel 62.

Referring to FIGS. 27 to 29, it can be seen that the extensible and compressible stop 94 includes a hollow cylinder 106 fixedly mounted at a front end 106A on the rear side 56A of the central portion 56 of the coin retainer backplate 20 so as to surround and define the bore 100 therein. The stop 94 also includes a piston cover button 108 of cylindrical shape movably mounted within an open rear end 106B of the cylinder 106 and constituting the rear end 94B of the stop 94, and a piston 110 having a cylindrical head 112 slidably mounted within the cylinder 106 and an elongated stem 114 attached at an inner end 114A to the head 112 and extending to an outer end 114B disposed within the bore 100 in the coin retainer backplate 20 and constituting the front end 94A of the stop 94. The stop 94 further includes a first coin spring 116 extending between and disposed at opposite ends 116A, 116B in respective depressions 108A, 112A in the piston cover button 108 and the head 112 of the piston 100. The first coin spring 116 in response to engagement of the piston cover button 108 by the cam surface 104 on the wedge-shaped protuberances 102 of the actuator 96 on the ratchet gear wheel 62 is sufficiently stiff so as to transmit to the piston 110 the depressing movement of the piston cover button 108 into the cylinder 106 so as to cause projection of the outer end 114B of the piston stem 114 beyond the bore 100 in the coin retainer backplate 20 in absence of a valid coin C in the coin receiving recess 46 of the coin carrier wheel 18, as shown in FIG. 28. Also the first coil spring 116 is sufficiently yieldable to absorb such depressing movement of the piston cover button 108 without transmitting the same to the piston 110 in the event of there being a valid coin C in the coin receiving recess 46 of the coin carrier wheel 18, as shown in FIG. 29, blocking the piston stem 114. The stop 94 still further includes a second coil spring 118 extending about the piston stem 114 between the head 112 of the piston 110 and the rear side 56A of the central portion 56 of the coin retainer backplate 20 and around the bore 100 therein such that the second coil spring 114 from beyond the coin retainer backplate 20 and into the bore 100 thereof and movement of the piston 110 and the piston cover button 108 away from the coin retainer backplate 20 upon disengagement of the piston cover button 108 by the cam surface 104 on the wedge-shaped protuberance 102 of the actuator 96 on the ratchet gear wheel 62.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereto.

The invention claimed is:

1. A coin-operated actuation mechanism of a vending machine, comprising:

(a) a coin carrier wheel mounted to undergo rotation about an axis in a given direction during a dispensing cycle of the vending machine, said coin carrier wheel having a peripheral edge and front and rear sides and at least one coin receiving recess defined in said rear side so as to extend to and open at said peripheral edge thereof and be spaced from said axis such that said coin receiving recess is adapted to receive a coin when said coin carrier wheel is disposed in an initial coin receiving position in the dispensing cycle;

(b) a coin retainer plate having front and rear sides and being mounted in a stationary position relative to said coin carrier wheel with said front side of said coin retainer plate disposed adjacent to said rear side of said coin carrier wheel such that said coin retainer plate retains the coin in said coin receiving recess of said coin carrier wheel as said coin carrier wheel is rotated about said axis in said given direction relative to said coin retainer plate from said initial position toward a coin discharging position;

(c) a structure mounted to undergo rotation with said coin carrier wheel and having a front surface spaced from and facing toward said rear side of said coin retainer plate as said structure rotates with said coin carrier wheel relative to said coin retainer plate from said initial position toward said coin discharge position, said structure also including means for preventing rotation of said coin carrier wheel and said structure therewith in a direction the reverse of said given direction once said coin carrier wheel has rotated through a predetermined angular displacement in said given direction from said initial position toward said coin discharge position; and (d) an anti-vandalism device including (i) a stop movably extendible and compressible in length and having a front end and a rear end and being mounted on a rear side of said coin retainer plate for undergoing movement between a forward blocking position and a rearward unblocking position, said front end of said stop in said forward blocking position projecting from and beyond a bore in said coin retainer plate and into an inner portion of said coin receiving recess of said coin carrier wheel when said coin receiving recess devoid of a valid coin is aligned with said bore in said coin retainer plate such that said front end of said stop will engage a segment of said coin carrier wheel at said trailing end of said coin receiving recess and block further rotation of said coin carrier wheel and said structure therewith in said given direction through said predetermined angular displacement from said initial position where halting of both forward and reverse rotation of said coin carrier wheel would occur, said front end of said stop in said rearward unblocking position being retracted into said bore in said coin retainer plate and out of said coin receiving recess of said coin carrier wheel so as not to block further rotation of said coin carrier wheel and said structure therewith in said given direction, and (ii) an actuator in the form of a cam surface defined on said front surface of said rotating structure in a position to engage said rear end of said stop and cause movement of said stop from its rearward unblocking position to its forward blocking position when said coin receiving recess is devoid of a valid coin and in response to rotation of said structure with said coin carrier wheel from said initial position in said given direction, said stop being compressible in length, when said coin receiving recess of said coin carrier wheel has a valid coin therein, in response to engagement of said front end of said stop with the coin such that due to the compression of the length of said stop said front end thereof does not extend beyond said hole in said coin retainer plate even though said rear end of said stop is engaged by said actuator on said rotating structure.

2. The actuation mechanism of claim 1 wherein said stop includes a hollow cylinder fixedly mounted at a front end on said rear side of said coin retainer plate so as to surround said bore therein.

3. The actuation mechanism of claim 2 wherein said stop further includes a piston cover button movably mounted by a rear end of said cylinder and constituting said rear end of said stop.

4. The actuation mechanism of claim 3 wherein said stop further includes a piston having a head slidably mounted within said cylinder adjacent to said rear end of said cylinder and an elongated stem attached at an inner end to said head and extending to an other end disposed within said bore in said coin retainer plate and constituting said front end of said stop.

5. The actuation mechanism of claim 4 wherein said stop further includes a first coil spring extending between and disposed at opposite ends in respective depressions in said piston cover button and said head of said piston, said first coil spring in response to engagement of said piston cover button by said cam surface on said rotating structure being sufficiently stiff to transmit to said piston the depressing movement of said piston cover button into said cylinder so as to cause projection of said outer end of said piston stem beyond said bore in said coin retainer plate in absence of a valid coin in said coin receiving recess of said coin carrier wheel and also said first coin spring being sufficiently yieldable to absorb such depressing movement of said piston cover button without transmitting the same to said piston in the event of there being a valid coin in said coin receiving recess of said coin carrier wheel blocking the movement of said piston stem beyond said bore.

6. The actuation mechanism of claim 5 wherein said stop further includes a second coil spring extending about said piston stem between said head of said piston and said rear side of said coin retainer plate and around said bore therein such that said second coil spring will cause retraction of said outer end of said piston stem from beyond said coin retainer plate and into said bore thereof and movement of said piston and said piston cover button away from said coin retainer plate upon disengagement of said piston cover button by said cam surface on said rotating structure.

7. The actuation mechanism of claim 1 wherein said structure is a ratchet gear wheel.

8. A coin-operated actuation mechanism of a vending machine, comprising:

(a) a cover plate with an axis extending therethrough and at least one coin insertion slot defined through an upper portion of said cover plate such that said coin insertion slot is disposed in spaced relation to and above said axis;

(b) a shaft extending through said cover plate along said axis from beyond a front side of said cover plate to beyond a rear side thereof;

(c) a coin carrier wheel fixedly mounted to said shaft to undergo rotation therewith relative to said cover plate and about said axis in a given direction through a dispensing cycle of the vending machine by turning said shaft in said given direction, said coin carrier wheel having a peripheral edge and front and rear sides and at least one coin receiving recess defined in said rear side so as to extend to and open at said peripheral edge thereof and be spaced from said axis such that said coin receiving recess is alignable with said coin insertion slot in said cover plate when said coin carrier wheel is disposed in an initial coin receiving position in the dispensing cycle in which a coin deposited through said slot is received in said coin receiving recess;

(d) a coin retainer plate attached to said cover plate so that a front side of said coin retainer plate is stationarily disposed adjacent to and faces toward said rear side of said coin carrier wheel such that said coin retainer plate retains the coin in said coin receiving recess of said coin carrier wheel as said coin carrier wheel is rotated with said shaft relative to said coin retainer plate and said cover plate, by turning said shaft, from said initial position toward a coin discharging position;

(e) a structure fixedly mounted to said shaft so that a front surface of said structure is spaced from and faces toward a rear side of said coin retainer plate as said structure and said coin carrier wheel are rotated with said shaft relative to said coin retainer plate and said cover plate from said initial position toward said coin discharge position, said structure also including means for preventing rotation of said shaft and said coin carrier wheel and said structure therewith in a direction the reverse of said given direction once said shaft has rotated through a predetermined angular displacement in said given direction from said initial position toward said coin discharge position; and (f) an anti-vandalism device including (i) a stop movably extendible and compressible in length and having a front end and a rear end and being mounted on a rear side of said coin retainer plate for undergoing movement between a forward blocking position and a rearward unblocking position wherein said forward blocking position said front end of said stop projects from and beyond a bore in said coin retainer plate and into an inner portion of said coin receiving recess of said coin carrier wheel when said coin receiving recess devoid of a valid coin is aligned with said bore in said coin retainer plate so that said front end of said stop will engage a segment of said coin carrier wheel at said trailing end of said coin receiving recess and block further rotation of said coin carrier wheel and said structure with said shaft in said given direction through said predetermined angular displacement from said initial position where halting of both forward and reverse rotation of said coin carrier wheel would occur and wherein said rearward unblocking position said front end of said stop is retracted into said bore in said coin retainer plate and out of said coin receiving recess of said coin carrier wheel so as not to block further rotation of said coin carrier wheel and said structure with said shaft in said given direction, and (ii) an actuator in the form of a cam surface defined on said front surface of said structure in a position to engage said rear end of said stop and cause movement of said stop from its rearward unblocking position to its forward blocking position when said coin receiving recess is devoid of a valid coin and in response to movement of said structure with said coin carrier wheel from said initial position in said given direction said stop being compressible in length when said coin receiving recess of said coin carrier wheel has a valid coin therein in response to engagement of said front end of said stop with the coin such that due to the compression of the length of said stop said front end thereof does not extend beyond said hole in said coin retainer plate even though said rear end of said stop is engaged by said actuator on said structure.

9. The actuation mechanism of claim 8 wherein said stop includes a hollow cylinder fixedly mounted at a front end on said rear side of said coin retainer plate so as to surround said bore therein.

10. The actuation mechanism of claim 9 wherein said stop further includes a piston cover button movably mounted by a rear end of said cylinder and constituting said rear end of said stop.

11. The actuation mechanism of claim 10 wherein said stop further includes a piston having a head slidably mounted within said cylinder adjacent to said rear end of said cylinder and an elongated stem attached at an inner end to said head and extending to an other end disposed within said bore in said coin retainer plate and constituting said front end of said stop.

12. The actuation mechanism of claim 11 wherein said stop further includes a first coil spring extending between and disposed at opposite ends in respective depressions in said piston cover button and said head of said piston, said first coil spring in response to engagement of said piston cover button by said cam surface on said rotating structure being sufficiently stiff to transmit to said piston the depressing movement of said piston cover button into said cylinder so as to cause projection of said outer end of said piston stem beyond said bore in said coin retainer plate in absence of a valid coin in said coin receiving recess of said coin carrier wheel and also said first coin spring being sufficiently yieldable to absorb such depressing movement of said piston cover button without transmitting the same to said piston in the event of there being a valid coin in said coin receiving recess of said coin carrier wheel blocking the movement of said piston stem beyond said bore.

13. The actuation mechanism of claim 12 wherein said stop further includes a second coil spring extending about said piston stem between said head of said piston and said rear side of said coin retainer plate and around said bore therein such that said second coil spring will cause retraction of said outer end of said piston stem from beyond said coin retainer plate and into said bore thereof and movement of said piston and said piston cover button away from said coin retainer plate upon disengagement of said piston cover button by said cam surface on said ratchet gear wheel.

14. The actuation mechanism of claim 8 wherein said structure is a ratchet gear wheel.

15. A coin-operated actuation mechanism of a vending machine, comprising:

(a) a cover plate having a rear recessed cavity at a rear side thereof, with an axis extending through said cavity, and at least one coin insertion slot defined through an upper portion of said cover plate and in communication with said cavity such that said coin insertion slot is disposed in spaced relation to and above said axis;

(b) a shaft extending through said cover plate and said cavity along said axis from beyond a front side of said cover plate to beyond said rear side thereof;

(c) a coin carrier wheel is disposed in said cavity of said cover plate and fixedly mounted to said shaft to undergo rotation therewith relative to said cover plate and about said axis in a given direction through a dispensing cycle of the vending machine by turning said shaft in said given direction, said coin carrier wheel including a body having a peripheral edge and front and rear sides and at least one coin receiving recess defined in said rear side of said body so as to extend to and open at said peripheral edge thereof and be spaced from said axis such that said coin receiving recess is alignable with said coin insertion slot in said cover plate when said coin carrier wheel is disposed in an initial coin receiving position in the dispensing cycle in which a coin deposited through said slot is received in said coin receiving recess;

(d) a coin retainer plate attached to said cover plate and extending across said rear recessed cavity of said cover plate so that a front side of said coin retainer plate is stationarily disposed adjacent to and faces toward said rear side of said coin carrier wheel such that said coin retainer plate retains the coin in said coin receiving recess of said coin carrier wheel as said coin carrier wheel is rotated with said shaft relative to said coin retainer plate and said cover plate, by turning said shaft, from said initial position toward a coin discharging position;

(e) a ratchet device including a ratchet gear wheel fixedly mounted to said shaft so that a front surface of said ratchet gear wheel is spaced from and faces toward a rear side of said coin retainer plate as said ratchet gear wheel and said coin carrier wheel are rotated with said shaft relative to said coin retainer plate and said cover plate from said initial position toward said coin discharge position, said ratchet device also including means for preventing rotation of said shaft and said coin carrier wheel and said ratchet gear wheel therewith in a direction reverse of said given direction once said shaft has rotated through a predetermined angular displacement away from said initial position toward said coin discharge position; and (f) an anti-vandalism device including (i) a stop movably extendible and compressible in length and having a front end and a rear end and being mounted on a rear side of said coin retainer plate for undergoing movement between a forward blocking position and a rearward unblocking position such that in said forward blocking position said front end of said stop projects from and beyond a bore in said coin retainer plate into an inner portion of said coin receiving recess when said coin receiving recess devoid of a valid coin is aligned with said bore in said coin retainer plate so that said front end of said stop will engage a segment of said coin carrier wheel at said trailing end of said coin receiving recess and block further rotation of said coin carrier wheel in said given direction where halting of both forward and reverse rotation of said coin carrier wheel would occur and such that in said rearward unblocking position said front end of said stop is retracted into said bore in said coin retainer plate and out of said coin receiving recess of said coin carrier wheel so as not to block further rotation of said coin carrier wheel in said given direction, and (ii) an actuator in the form of a cam surface defined on said front surface of said ratchet gear wheel in a position to engage said rear end of said stop and cause movement of said stop from its rearward unblocking position to its forward blocking position when said coin receiving recess is devoid of a valid coin and in response to movement of said ratchet gear wheel with said coin carrier wheel from said initial position in said given direction, said stop being compressible in length, when said coin receiving recess of said coin carrier wheel has a valid coin therein, in response to engagement of said front end of said stop with the coin such that due to the compression of the length of said stop said front end thereof does not extend beyond said hole in said coin retainer plate even though said rear end of said stop is engaged by said actuator on said ratchet gear wheel.

16. The actuation mechanism of claim 15 wherein said stop includes a hollow cylinder fixedly mounted at a front end on said read side of said coin retainer plate so as to surround said bore therein.

17. The actuation mechanism of claim 16 wherein said stop further includes a piston cover button movably mounted by a rear end of said cylinder and constituting said rear end of said stop.

18. The actuation mechanism of claim 17 wherein said stop further includes a piston having a head slidably mounted within said cylinder adjacent to said rear end of said cylinder and an elongated stem attached at an inner end to said head and extending to an other end disposed within said bore in said coin retainer plate and constituting said front end of said stop.

19. The actuation mechanism of claim 18 wherein said stop further includes a first coil spring extending between and disposed at opposite ends in respective depressions in said piston cover button and said head of said piston, said first coil spring in response to engagement of said piston cover button by said cam surface on said ratchet gear wheel being sufficiently stiff to transmit to said piston the depressing movement of said piston cover button into said cylinder so as to cause projection of said outer end of said piston stem beyond said bore in said coin retainer plate in absence of a valid coin in said coin receiving recess of said coin carrier wheel and also said first coin spring being sufficiently yieldable to absorb such depressing movement of said piston cover button without transmitting the same to said piston in the event of there being a valid coin in said coin receiving recess of said coin carrier wheel blocking the movement of said piston stem beyond said bore.

20. The actuation mechanism of claim 19 wherein said stop further includes a second coil spring extending about said piston stem between said head of said piston and said rear side of said coin retainer plate and around said bore therein such that said second coil spring will cause retraction of said outer end of said piston stem from beyond said coin retainer plate and into said bore thereof and movement of said piston and said piston cover button away from said coin retainer plate upon disengagement of said piston cover button by said cam surface on said ratchet gear wheel.

* * * * *